US006388691B1

(12) United States Patent
Maeyama et al.

(10) Patent No.: US 6,388,691 B1
(45) Date of Patent: May 14, 2002

(54) HEAD CONTROLLER OF THERMAL PRINTER AND THERMAL PRINTER PRINTING METHOD

(75) Inventors: Sadao Maeyama, Chiba; Minoru Yamazaki, Kanagawa, both of (JP)

(73) Assignee: Sony Corporation, Tokyo (JP)

( * ) Notice: Subject to any disclaimer, the term of this patent is extended or adjusted under 35 U.S.C. 154(b) by 33 days.

(21) Appl. No.: 09/656,112

(22) Filed: Sep. 6, 2000

(30) Foreign Application Priority Data

Sep. 8, 1999 (JP) ..... 11-254478

(51) Int. Cl.[7] ..... B41J 2/35
(52) U.S. Cl. ..... 347/183; 347/211
(58) Field of Search ..... 347/183, 211; 400/120.07

(56) References Cited

U.S. PATENT DOCUMENTS 5,006,865 A * 4/1991 Kuroiwa ..... 347/183

* cited by examiner

*Primary Examiner*—Huan Tran
(74) *Attorney, Agent, or Firm*—Crosby, Heafy, Roach & May

(57) ABSTRACT

The present invention overcomes disadvantages including the occurrence of uneven printing, the need to provide a large-sized power supply, high cost and the deterioration of energy conversion efficiency resulting from the application of high current to the common resistance of a line head in a thermal printer for printing an image by the line head. Specifically, a gradation generating means (14) for generating gradation data; a selection means (15) for alternatively selecting each image data the number of which corresponds to the number of head elements of a head, and data of value 0 for the respective image data, and for switching selection as to which data is to be selected, the image data or the data of value 0, every time a value of the gradation data changes; and a comparison means (16) for feeding signals each indicating a comparison result of comparing the data selected by the selection means (15) with the gradation data, are provided at a line head controller (7) of a thermal printer.

18 Claims, 7 Drawing Sheets

HEAD CONTROLLER OF THERMAL PRINTER AND THERMAL PRINTER PRINTING METHOD

BACKGROUND OF THE INVENTION

1. Field of the Invention

The present invention relates to a printer printing an image with a line head and particularly relates to a printer characterized by having a line head controller for controlling the line head.

2. Description of the Related Art

A thermosensitive printer (thermal printer) is a widely used printer type. The thermal printer applies current according to gradations (image tones from white to black) to the head elements of a head, thereby transferring a thermal-melting or thermal-sublimating material coated on a ribbon to a medium by the heat of the head elements or coloring a thermosensitive material coated on a medium by the heat of the head elements.

FIG. 1 shows one example of the constitution of a line head controller which is a circuit provided to control current applied to the respective head elements of the line head in a conventional thermal printer for printing an image by the line head. In this line head controller (to be referred to simply as head controller hereinafter) 51, N pieces of image data for one line among the image data represent gradations at the positions of dots on the respective lines of a medium width, for example, eight bits (i.e., with 256 density levels), respectively. If the number of dots per line is, for example, 2056, then 2056 image data are written to a line memory 52.

A gradation counter 53 is a counter which counts up gradation data from a minimum value 0 to a maximum value 255 of 256 gradations each represented by eight bits, with a clock signal CK used as an operating clock, after the counter 53 is reset at an initial value 0 by a reset signal RS.

First, when the value of the gradation counter 53 is 0, image data are read out one by one from the line memory 52 and a comparator 54 compares each of the image data with the value of the gradation data. When the value of the image data is higher than the value of the gradation data, a H (high) signal CP is outputted from the comparator 54 and when lower, an L (low) signal CP is outputted from the comparator 54.

The signals CP each indicating a comparison result as well as shift pulses (not shown) are sequentially fed from the head controller 51 to a sift register 62 in the line head (to be referred to simply as head hereinafter) 61. As a result, by the time the comparator 54 completes comparison for all the image data for one line read from the line memory 52, signals indicating whether the density levels of the image at the respective dot positions on this one line are higher than 0 are stored in the shift register 62 in the head 61.

When the comparator 54 completes comparison with respect to all the image data corresponding to one line and read from the line memory 52, the head controller 51 allows the signals stored in the shift register 62 in the head 61 to be outputted simultaneously and to be latched by a latch circuit 63 in the head 61. The respective signals latched by the latch circuit 63 are supplied to head elements in the head 61.

FIG. 2 shows one example of the structure of the head element. Transistors 65 are arranged on a substrate (not shown in FIG. 2) so as to correspond to the respective positions of dots on one line (therefore, the number of transistors 65 is N, equal to the number of dots per line), and each of the transistors 65 functions as one piece of the head element. The collector of each transistor 65 is connected in parallel to a semiconductor 66 through a resistor 64. Both ends of the semiconductor 66 are connected to a power terminal 68 using a copper wire 67. The emitter of each transistor 65 is connected to an earth terminal 70 using a copper wire 69.

Each of the signals latched by the latch circuit 63 shown in FIG. 1 is supplied to the base of each transistor 65 at the position of a corresponding dot. Thus, current is applied only to transistors 65 to the bases of which H signals are supplied (which transistors 65 are located at positions corresponding to the positions of dots having density levels higher than 0) and only these transistors 65 are heated.

Next, in the head controller 51, the gradation counter 53 counts up gradation data by one. Image data are read again from the line memory 52 one by one and each of the image data is compared with the value 1 of the gradation data by the comparator 54. When the comparison is completed, the signals stored in the shift register 62 in the head 61 are latched anew by the latch circuit 63 in the head 61. By doing so, current is applied only to transistors to which bases H signals are supplied (which transistors 65 in this case are located at positions corresponding to the positions of dots having density levels higher than 1) and only these transistors 65 are therefore heated.

Thereafter, the head controller 51 continues the same processings repeatedly, while the gradation counter 53 counts up gradation data one at a time up to a maximum value 255. As a result, H signals (i.e., PWM signals which density levels are modulated to pulse widths) are supplied to the bases of the respective transistors 65 for a period of time according to gradations at their corresponding dot positions. Therefore, current flows for a period of time according to the gradations. A thermal-melting or thermal-sublimating material coated on a ribbon is transferred to a medium by the heat of the respective transistors 65 (or a thermosensitive material coated on the medium is colored as a result of heat generated at the transistors 65 due to the application of current to the transistors 65), whereby an image corresponding to one line is written on the medium.

After the image corresponding to one line is written, the gradation counter 53 is reset at the initial value 0 in the head controller 51 and image data corresponding to the next line are written to the line memory 52. The above-stated steps are conducted repeatedly for these image data.

In the meantime, according to the conventional head controller 51 as stated above, while the value of the gradation data at the gradation counter 53 is close to a minimum value 0, H signals CP are outputted from the comparator 54 for almost all image data read from the line memory 52. During this period, therefore, current is simultaneously applied to almost all transistors 65 of the head 61.

As stated above, if current is simultaneously applied to almost all transistors 65, high current flows through the semiconductor 66 and the copper wire 67 (a resistor common to the transistors 65) correspondingly. If the number of transistors 65 is 2056, current flowing through the common resistor (to be referred to as "common resistance" hereinafter) is, for example, 8 to 10 amperes. If such high current is applied to the common resistance, the following disadvantages occur.

(1) Generally, in a thermal printer, the length of time for allowing the latch circuit 63 of the head 61 to latch signals (i.e., the length of time for applying current to the transistors 65) is corrected within a range of a cycle in which the gradation counter 53 counts up gradation data, in accordance with the number of image data for which H signals CP are outputted from the comparator 54 of the head controller 51, thereby suppressing the occurrence of uneven printing derived from a voltage drop at the common resistance (particularly the voltage drop at the semiconductor 66), which correction will be referred to as "number correction". If current as high as 8 to 10 amperes is applied to the common resistance, however, the voltage drop becomes larger at the common resistance. Thus, even if this number correction is made, it becomes impossible to suppress the occurrence of uneven printing.

(2) The period of time for which current flows through almost all transistors 65 is a period for which the value of the gradation data at the gradation counter 53 is close to a minimum value 0. For that reason, although the period is only part of the time needed for printing images for one line, it is required to provide a large-sized, expensive power supply capable of supplying current as high as 8 to 10 amperes to the head 61 for that period.

(3) Due to a large voltage drop at the common resistance, efficiency for converting the electric energy of the power supply into the heat energy of the transistors 65 deteriorates. Here, if the resistances of the individual head elements are increased, current applied to each head element decreases, thereby making it possible to decrease the current flowing through the common resistance even in a period in which current is simultaneously applied to almost all the head elements. However, developing a head having high-resistance head elements disadvantageously makes the design and manufacturing processes complex and costly.

SUMMARY OF THE INVENTION

The present invention has been made in view of the above-stated disadvantages and the object of the present invention is to overcome the disadvantages including the occurrence of uneven printing, the need to provide a large-sized power supply, high cost and the deterioration of energy conversion efficiency resulting from the application of high current to the common resistance of a line head. Thus, instead of developing a line head having high-resistance head elements, an available line head is used in a thermal printer for printing an image.

To obtain the above object, the applicant of the present invention proposes a line head controller of a thermal printer printing an image by a line head, for generating gradation data representing image gradations by stages; alternately selecting each image data the number of which corresponds to the number of head elements of the line head, and data of value 0, and switching selection as to which data is to be selected, the image data or the data of value 0, every time a value of the gradation data changes; and feeding a signal indicating a comparison result of comparing the selected data with the gradation data to the line head.

In this line head controller, for the number of image data corresponding to the number of the head elements of the line head, each image data and the data of value 0 are alternately selected and the selected data is compared with the gradation data. Then, for each image data, selection is switched as to which data is to be selected, the image data or the data of value 0, every time the value of the gradation data changes.

Accordingly, in any periods in which the gradation data has a given value, the data of value 0 is selected and compared with the gradation data for half the image data among the image data the number of which corresponds to the number of the head elements. Thus, the signal indicating that the value of the image data is higher than the value of the gradation data, is not fed to the line head.

Consequently, in the thermal printer provided with this line head controller, the number of the head elements applied with current becomes about half the number of the head elements in the printer provided with the conventional line head controller such as the head controller 51 shown in FIG. 1 (i.e., the total current flowing through the respective head elements is reduced to about half the current in the conventional case) throughout the periods in which the gradation data have all values (i.e., the entire printing time for one line).

Therefore, even in a period in which the value of the gradation data is close to the minimum value, current is not simultaneously applied to almost all the head elements but applied only to approximately half the head elements, so that the maximum value of the total current flowing through the respective head elements is reduced to a half of the current in the conventional case.

As a result, current flowing through the common resistance of the line head becomes greatly lower than the current in the conventional case, while using the same head as the conventional line head without newly developing a line head having high-resistance head elements. This can overcome disadvantages including the occurrence of uneven printing, the need to provide a large-sized power supply, high cost and the deterioration of energy conversion efficiency as described in (1) to (3) above.

The individual image data are compared with every other value of the gradation data and two image data corresponding to adjacent two head elements are compared with gradation data different from each other. Accordingly, an image composed by images printed by adjacent two head elements (i.e., by images located at the positions of two adjacent dots) is printed with the same gradations as that in case of comparing the image data with all the values of the gradation data. It is, therefore, possible to prevent the gradations from appearing coarser when viewing a printed image.

It is noted that the line head controller is more preferably constructed to switch the selection per line as to which data is to be selected, the image data or the data of value 0, for the respective image data with the gradation data being the same value.

By doing so, the selection is switched every line as to which data is compared with the gradation data, each image data or the data of value 0 with regard to the respective image data corresponding to the same head element. Due to this, not only an image composed by images printed by adjacent two head elements (i.e., images located at positions of two adjacent dots in a line direction) but also an image printed on adjacent two lines by the same head element (i.e., images located at positions of two adjacent dots in cross direction) can be printed with the same gradations as those in case of comparing the image data with all values of the gradation data. It is, therefore, possible to further prevent the gradations from appearing coarser when viewing a printed image.

Further, it is more preferable that the line head controller is constituted to feed a signal correcting current-carrying time for carrying current to head elements of the line head to the line head in accordance with the signal indicating the comparison result. By doing so, it is possible to more suppress the generation of uneven printing resulting from voltage drop at the common resistance of the line head.

Next, the applicant of the present invention proposes a printer printing an image by a line head, comprising a line head controller for controlling generating gradation data representing image gradations by stages; for alternately selecting each image data the number of which corresponds to the number of head elements of the line head, and data of value 0, and switching selection as to which data is to be selected, the image data or the data of value 0, every time a value of the gradation data changes; and for feeding a signal indicating a comparison result of comparing the selected data with the gradation data to the line head.

This printer is provided with the above-stated line head controller according to the present invention. Therefore, if the printer is a thermal printer, the disadvantages including the occurrence of uneven printing, the need to provide a large- sized power supply, high cost and the deterioration of energy conversion efficiency as stated in (1) to (3) above are overcome, and the gradations are prevented from appearing coarser if viewing a printed image.

In case of the printer as in the case of the above, it is more preferable that the line head controller is constituted to switch the selection as to which data is to be selected, the image data or the data of value 0 with the gradation data being a same value per line for the respective image data, and to feed a signal correcting current-carrying time for carrying current to the head element of the line head to the line head in accordance with the signal indicating the comparison result.

Further, the applicant of the present invention proposes a line head controller of a thermal printer printing an image by a line head, comprising: gradation generation means for generating gradation data representing image gradations by stages; selection means for alternately selecting each image data the number of which corresponds to the number of head elements of the line head, and data of value 0, and for switching selection as to which data is to be selected, the image data or the data of value 0, every time a value of the gradation data changes; and comparison means for feeding a signal indicating a comparison result of comparing the selected data with the gradation data to the line head.

According to this line head controller, the disadvantages of the thermal printer including the occurrence of uneven printing, the need to provide a large-sized power supply, high cost and the deterioration of energy conversion efficiency as stated in (1) to (3) above are overcome, and the gradations are prevented from appearing coarser if viewing a printed image.

In case of the printer as in the case of the above, it is more preferable that the line head controller is constituted to switch the selection as to which data is to be selected, the image data or the data of value 0 with the gradation data being a same value per line for the respective image data, and to further comprise voltage drop correction means for feeding a signal correcting current-carrying time for carrying current to the head elements of the line head to the line head in accordance with the signal indicating the comparison result.

Next, the applicant of the present invention proposes a thermal printer printing an image by a line head, comprising a line head controller, the line head controller comprising: gradation generation means for generating gradation data representing image gradations by stages; selection means for alternately selecting each image data the number of which corresponds to the number of head elements of the line head, and data of value 0, and for switching selection as to which data is to be selected, the image data or the data of value 0, every time a value of the gradation data changes; and comparison means for feeding a signal indicating a comparison result of comparing the selected data with the gradation data to the line head.

According to this line head controller, the disadvantages of the thermal printer including the occurrence of uneven printing, the need to provide a large-sized power supply, high cost and the deterioration of energy conversion efficiency as stated in (1) to (3) above are overcome, and the gradations are prevented from appearing coarser if viewing a printed image.

In case of the printer as in the case of the above, it is more preferable that the line head controller is constituted to switch the selection as to which data is to be selected, the image data or the data of value 0 with the gradation data being a same value per line for the respective image data, and to further comprise voltage drop correction means for feeding a signal correcting current-carrying time for carrying current to the head elements of the line head to the line head in accordance with the signal indicating the comparison result.

Next, the applicant of the present invention proposes a printer printing method of printing an image by a line head, comprising: a gradation generation step of generating gradation data representing image gradations by stages; a selection step of alternately selecting each image data the number of which corresponds to the number of head elements of the line head, and data of value 0, and of switching selection as to which data is to be selected, the image data or the data of value 0, every time a value of the gradation data changes; and a comparison step of feeding a signal indicating a comparison result of comparing the selected data with the gradation data to the line head.

According to this printing method, if the printer is a thermal printer, the disadvantages including the occurrence of uneven printing, the need to provide a large-sized power supply, high cost and the deterioration of energy conversion efficiency as stated in (1) to (3) above are overcome, and the gradations are prevented from appearing coarser if viewing a printed image.

In case of this printing method as in the case of the above, it is more preferable that in the selection step, the selection as to which data is to be selected, the image data or the data of value 0 with the gradation data being a same value is switched per line for the respective image data, and that the printing method further comprises a voltage drop correction step of feeding a signal correcting current-carrying time for carrying current to head elements of the line head to the line head in accordance with the signal indicating the comparison result.

DETAILED DESCRIPTION OF THE PREFERRED EMBODIMENTS

An example of applying the present invention to a thermal printer will be described hereinafter.

Figure 3:
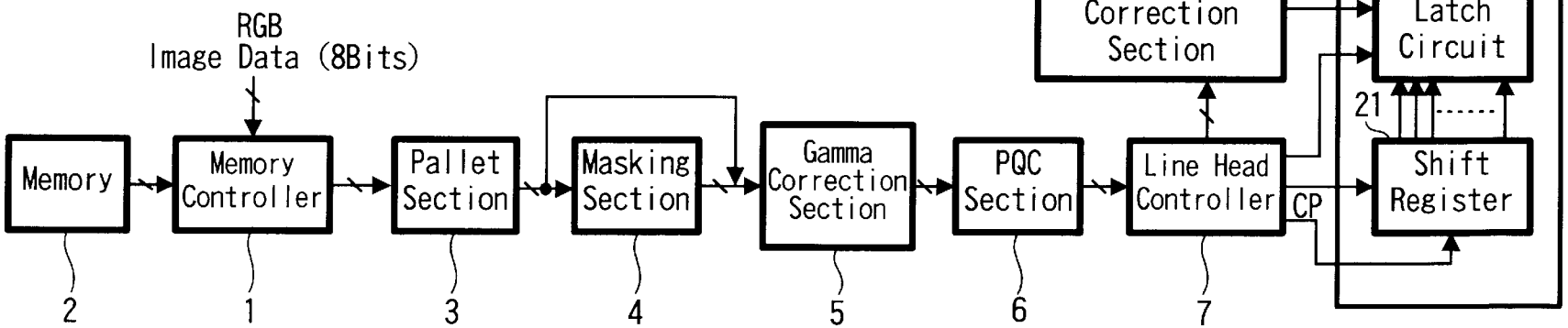
FIG. 3 is a block diagram showing the overall constitution of signal processing systems in a thermal printer to which the present invention is applied.

FIG. 3 is a block diagram showing the overall constitution of signal processing systems in a thermal printer to which the present invention is applied.

Image data of RGB primary colors representing gradations at the positions of 2056 dots per line with eight bits (i.e., 256 density levels), respectively, is supplied to this thermal printer externally and written to a memory 2 under the control of a memory controller 1. When printing an image, the RGB image data written to the memory 2 is read by the memory controller I and fed to a line head controller (to be referred to simply as head controller hereinafter) 7 by way of a pallet section 3, a masking section 4, a gamma correction section 5 and a PQC (Picture Quality Control) section 6.

The pallet section 3 conducts a processing for converting the RGB image data into image data of Y (yellow), M (magenta) and C (cyan).

The masking section 4 conducts a processing for correcting the turbidity of reproduced colors derived from the spectral characteristics of the three color materials of Y, M C coated on a ribbon.

The gamma correction section 5 conducts a processing for correcting the image data in accordance with the color characteristics relative to the heat of the thermal-melting or thermal-sublimating material coated on the ribbon (or a thermosensitive material coated on a medium).

The PQC section 6 conducts a processing for correcting the image data in accordance with the temperature rise characteristics of head elements at the time of starting application of current and the thermal storage effect of the head elements after a temperature rise.

Figure 4:
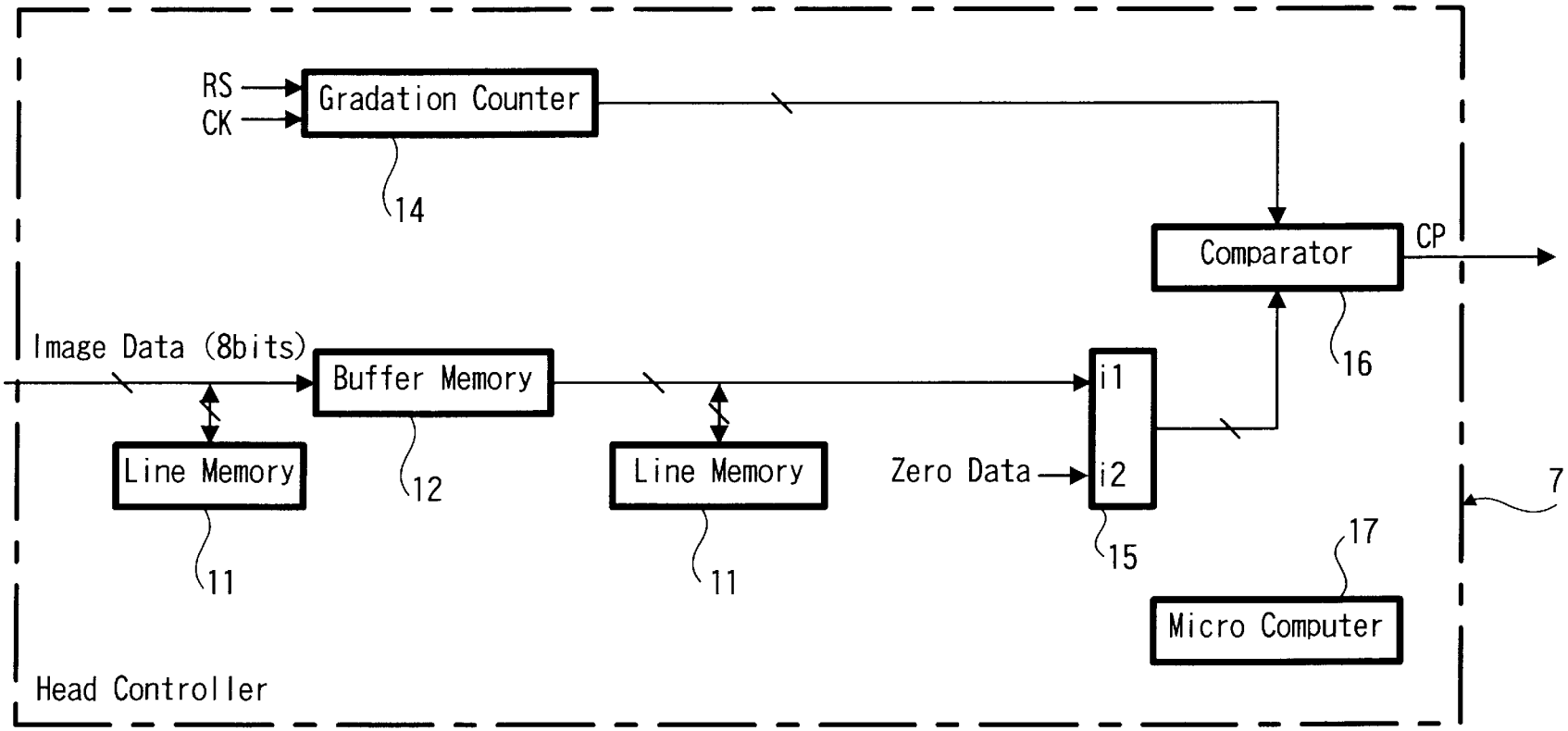
FIG. 4 is a block diagram showing one example of the constitution of a line head controller shown in FIG. 3.

FIG. 4 shows one example of the constitution of the head controller 7. The head controller 7 is provided with a line memory 11, a buffer memory 12, a line memory 13, a gradation counter 14, a 2-input, 1-output selector 15, a comparator 16 and a microcomputer 17. The microcomputer 17 controls the respective constituent elements of the head controller 7, as well as a line head 9 and a voltage drop correction section 8 to be described later.

Among the image data fed from the PQC section, 2056 image data corresponding to the first one line are written to the line memory 13 through the buffer memory 12. Also, 2056 image data corresponding to the next one line are written to the line memory 11.

The gradation counter 14 is a counter for counting up gradation data one by one from a minimum value 0 to a maximum value 255 of 256 gradations each represented by 8 bits, with a clock signal CK used as an operating clock after the counter 14 is reset at an initial value 0 by a reset signal RS.

The image data read from the line memory 13 are inputted to one input terminal i1 of the selector 15 and 8-bit data of value 0 (to be referred to as zero data hereinafter) is inputted to the other input terminal i2 of the selector 15. Control signals which contents are shown in the following items (a) to (d) are applied to the control input terminal of the selector 15.

(a) When an image is printed on an odd-numbered line, the value of gradation data is even (0, 2, . . . or 254) and the odd-numbered image data (1st, 3rd, . . . or 2055th image data) (i.e., image data at the position of an odd-numbered dot on one line) is read from the line memory 13, the image data inputted to the input terminal i1 is selected. On the other hand, when the even-numbered image data (2nd, 4th, . . . or 2056th image data) (i.e., image data at the position of an even-numbered dot on one line) is read from the line memory 13, the zero data inputted to the input terminal i2 is selected.

(b) When an image is printed on an odd-numbered line, the value of the gradation data is odd (1, 3, . . . or 255) and odd-numbered image data is read from the line memory 13, the zero data inputted to the input terminal i2 is selected. When the even-numbered image data is read from the line memory 13, the image data inputted to the input terminal i1 are selected.

(c) When an image is printed on an even-numbered line, the value of the gradation data is even and odd-numbered image data is read from the line memory 13, the zero data inputted to the input terminal i2 is selected. On the other hand, when the even-numbered image data is read from the line memory 13, the image data inputted to the input terminal i1 is selected.

(d) When an image is printed on an even-numbered line, the value of the gradation data is odd and odd-numbered image data is read from the line memory 13, the image data inputted to the input terminal i1 is selected. On the other hand, when the even-numbered image data is read from the line memory 13, the zero data inputted to the input terminal i2 is selected.

The data selected by the selector 15 is fed to the comparator 16, which compares the data with the gradation data from the gradation counter 14.

First, when the image is printed on the first line and the gradation data at the gradation counter 14 is a minimum value of 0, the image data are read one by one from the line memory 13. At this moment, since the values of the gradation data are even, the selector 15 is applied with the control signal as described above in the item (a). Thus, when the odd-numbered image data (1st, 3rd, . . . or 2055th image data) is read from the line memory 13, the selector 15 selects the image data. When even-numbered image data (2nd, 4th, . . . or 2056th image data) is read from the line memory 13, the selector 15 selects the zero data.

Figure 5:
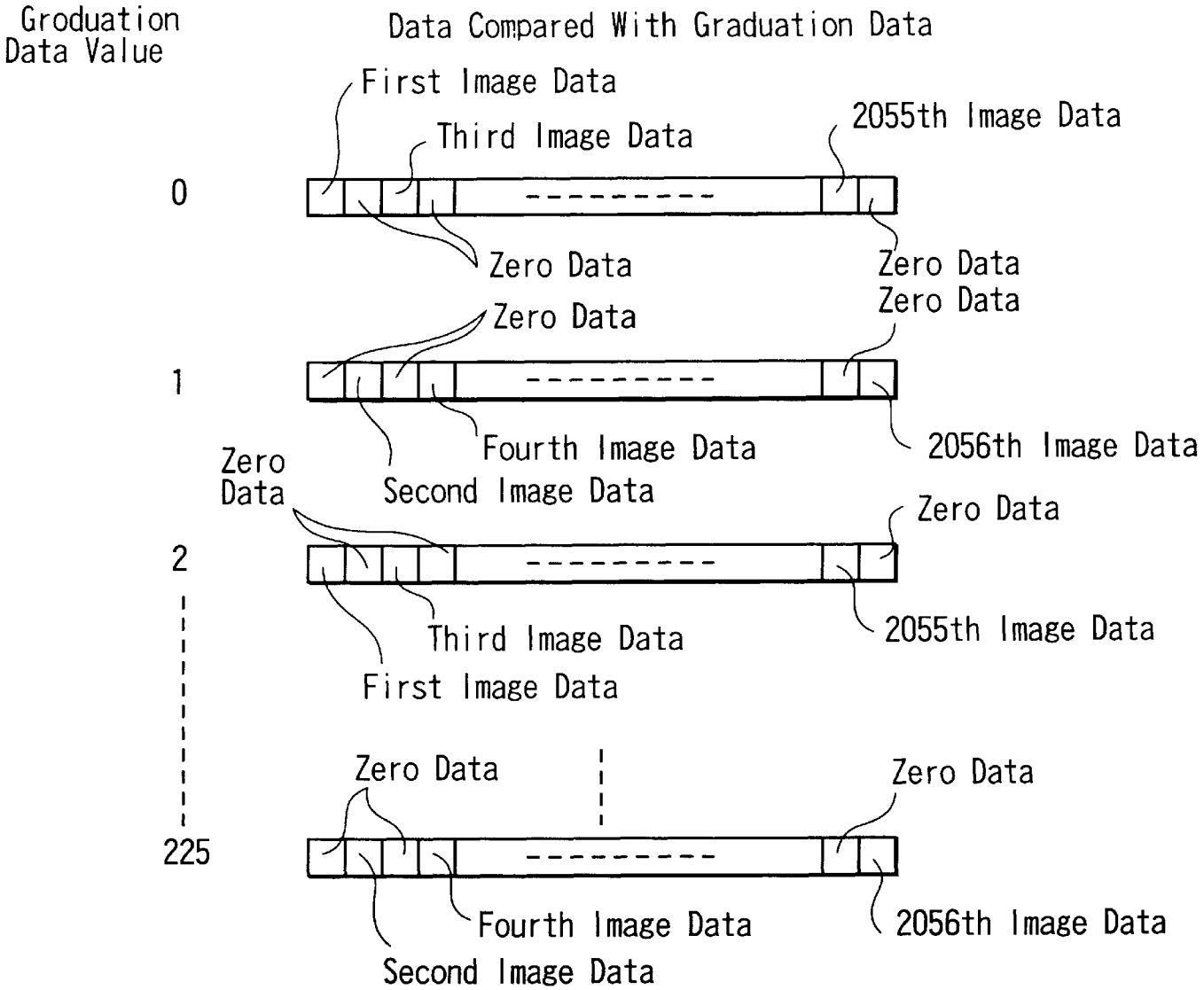
FIG. 5 is a view showing image data compared with the respective values of gradation data by a comparator shown in FIG. 4 at the time of printing an image on an odd-numbered line.

Accordingly, as shown in FIG. 5, when the odd-numbered image data is read from the line memory 13, the image data thus read is compared with the gradation data of value 0. When the even-numbered image data is read from the line memory 13, the zero data is compared with the gradation data of value 0.

If the value of the data of the selector 15 is higher than the value of the gradation data, the comparator 16 outputs an H (high) signal CP. Otherwise, the comparator 16 outputs an L (low) signal CP. Therefore, when the even-numbered image data is read from the line memory 13, the comparator 16 does not output an H signal CP (which indicates the comparison result that the value of the even-numbered image data is higher than the value of the gradation data) but only outputs an L signal CP.

The signals CP indicating comparison results as well as shift pulses (not shown) from the microcomputer 17 are sequentially fed from the head controller 7 to the shift register 21 in the head 9 shown in FIG. 3. By doing so, by the time the comparator 16 completes comparison with regard to all image data on one line read from the line memory 13, signals indicating whether or not density levels of the images at the positions of odd-numbered dots (1st, 3rd, . . . , 2055th) on the one line are higher than 0, respectively, are stored in the shift register 21 in the head 9 but signals indicating that image density levels at the positions of even-numbered dots (2nd, 4th, . . . , 2056th dots) on the one line are not stored in the shift register 21.

When the comparator 16 completes comparison with regard to all the image data on one line read from the line memory 13, the microcomputer 17 allows the signals stored in the shift register 21 in the head 9 to be simultaneously outputted from the shift register 21 and to be latched by the latch circuit 22 in the head 9 shown in FIG. 3. The respective signals latched by the latch circuit 22 are supplied to the head elements in the head 9.

Figure 2:
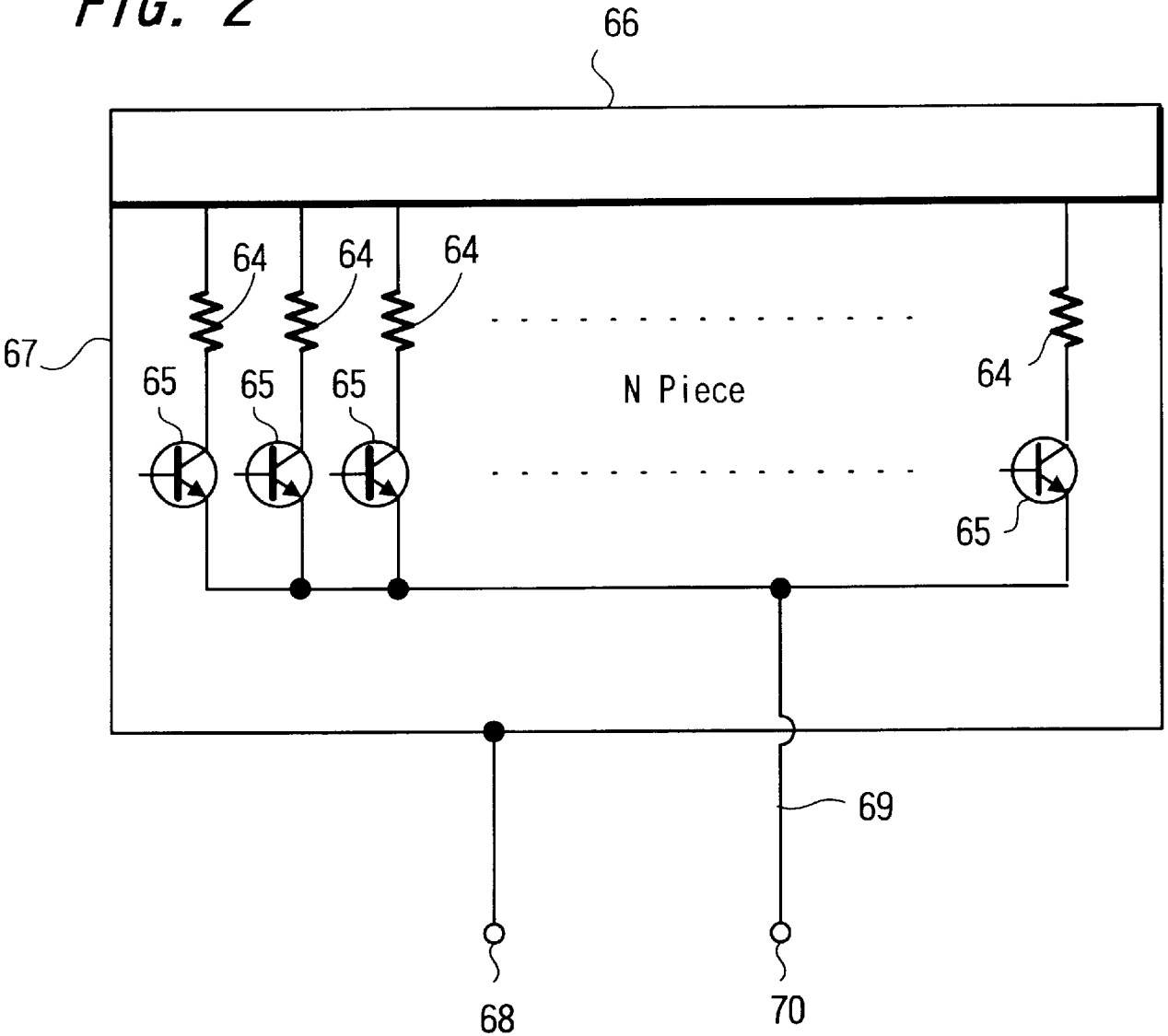
FIG. 2 is a view showing one example of the structure of a head element.

The structure of a head element is what is shown in, for example, FIG. 2 (in which case, N=2056) and the respective signals latched by the latch circuit 22 are supplied to the bases of transistors 65 at corresponding dot positions. As a result, current is applied only to the transistors 65 which bases are supplied with H signals (which transistors 65 in this case correspond to the positions of dots having density levels higher than 0 among those corresponding to the positions of odd-numbered dots) and only these transistors 65 are, therefore, heated.

Next, in the head controller 7, the gradation counter 14 counts up the gradation data by one. Then, the image data are read again one by one from the line memory 13. Since the values of the gradation data are odd this time, the selector 15 is applied with the control signal as described above in the item (b). Thus, when the odd-numbered image data are read from the line memory 13, the selector 15 selects the zero data. When the even-numbered image data are read from the line memory 13, the selector 15 selects the image data thus read.

Accordingly, as shown in FIG. 5, when the odd-numbered image data is read from the line memory 13, the zero data is compared with the gradation data of value 1. When the even-numbered image data is read from the line memory 13, the image data thus read are compared with the gradation data of value 1. Therefore, when the odd-numbered image data is read from the line memory 13, the comparator 16 does not output an H signal CP (which indicates a comparison result that the value of the odd-numbered image data is higher than the value of the gradation data) but only outputs an L signal CP.

As a result, the shift register 21 in the head 9 stores signals each indicating whether or not a image density level at the position of an even-numbered dot on one line is higher than 1 but not signals each indicating whether or not an image density level on the position of an odd-numbered dot on the line is higher than 1. Due to this, current is applied to the transistors 65 corresponding to the positions of dots having density levels higher than 1 among those corresponding to the positions of even-numbered dots.

Thereafter, whenever the gradation counter 14 in the head controller 7 counts up the gradation data to 255 one by one, the head controller 7 repeats the same processings while, with regard to the image data read out one by one from the from the line memory 13, switching the selection as to which data is to be selected by the selector 15, each image data thus read or the zero data.

As shown in FIG. 5, therefore, when the value of the gradation data is even (2, 4, . . . or 254) and the odd-numbered image data and even-numbered image data are read from the line memory 13, the image data thus read and the zero data are compared with the value of the gradation data, respectively. On the other hand, when the value of the gradation data is odd (3, 5, . . . or 255) and the odd-numbered image data and even-numbered image data are read from the line memory 13, the zero data and the image data thus read are compared with the value of the gradation data, respectively.

Thus, when the value of the gradation data is even, current is applied only to the transistors 65 corresponding to the positions of dots having density levels higher than 0 among those corresponding to the positions of odd-numbered dots. When the value of the gradation data is odd, current is applied only to the transistors 65 corresponding to the positions of dots having density levels higher than 0 among those corresponding to the positions of even-numbered dots.

Consequently, H signals are supplied to the bases of the transistors 65, respectively, for a period in accordance with the gradations at the positions of the corresponding dots (that is, PWM signals which density levels are subjected to pulse-width modulation are supplied to the bases of the transistors 65), and current flows for a period according to the gradations. The thermal-melting or thermal-sublimating material coated on the ribbon, which is not shown, is transferred to a medium by the heat of the respective transistors 65 generated as a result of the application of current, thereby printing the image for one line on the medium.

After the image is printed on the first line as described above, the gradation counter 14 in the head controller 7 is reset at an initial value 0. The 2056 image data for the next one line written to the line memory 11 are newly written to the line memory 13 through the buffer memory 12 and the same processings as those described above are repeated for these image data. In addition, 2056 image data for the further next one line are newly written to the line memory 11.

Figure 6:
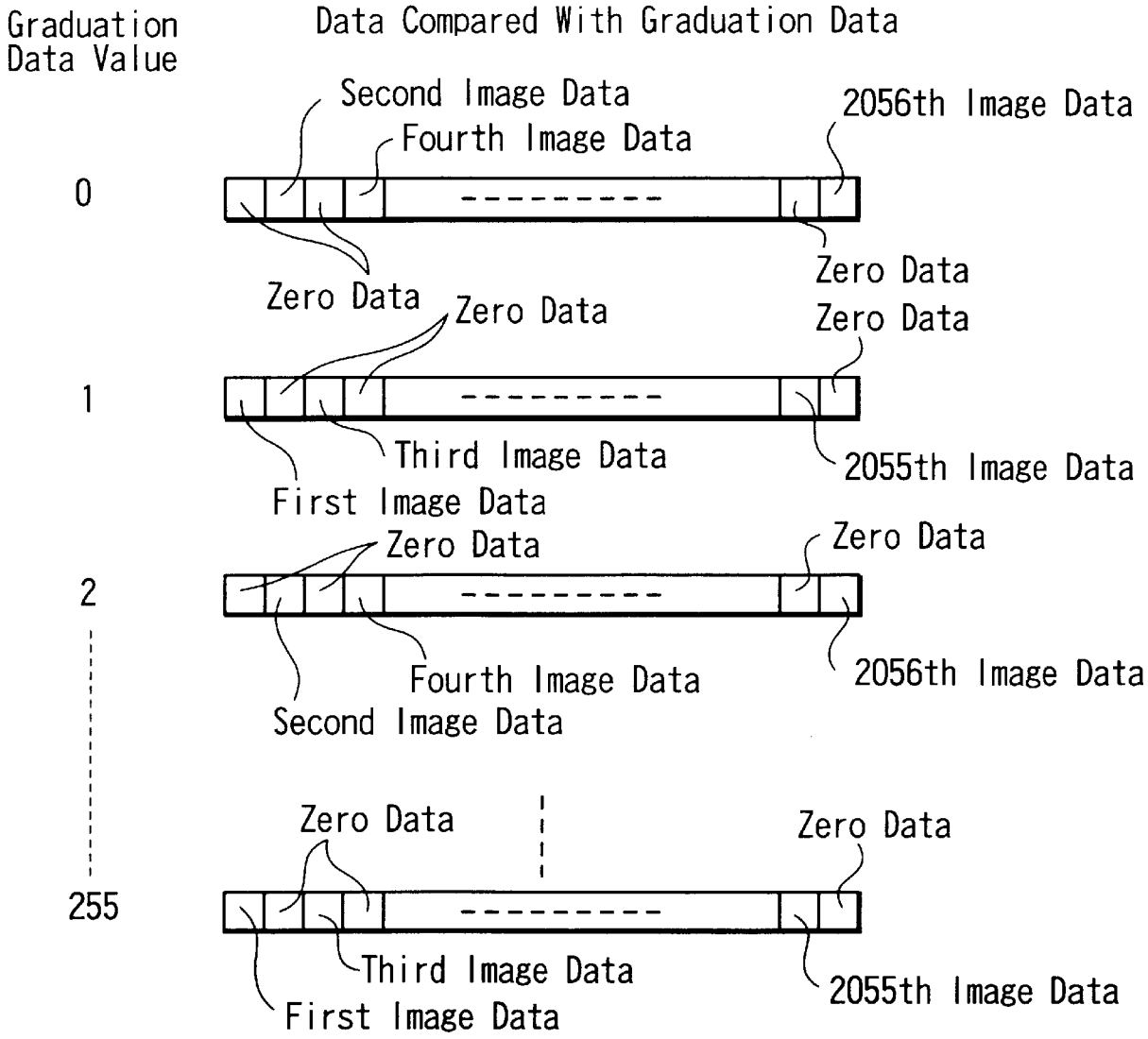
FIG. 6 is a diagram showing image data compared with the respective values of gradation data by the comparator shown in FIG. 4 at the time of printing an image on an even-numbered line.

When an image is printed on the second line, however, the control signals as described above in the items (c) and (d) are applied to the selector 15. Due to this, oppositely to a case of printing an image on the first line, when the value of the gradation data is even and the odd-numbered and even-numbered image data are read from the line memory 13, the zero data and the image data thus read are compared with the gradation data, respectively, as shown in FIG. 6. When the value of the gradation data is odd and the odd-numbered and even-numbered image data are read from the line memory 13, the image data thus read and the zero data are compared with the value of the gradation data, respectively.

Figure 1:
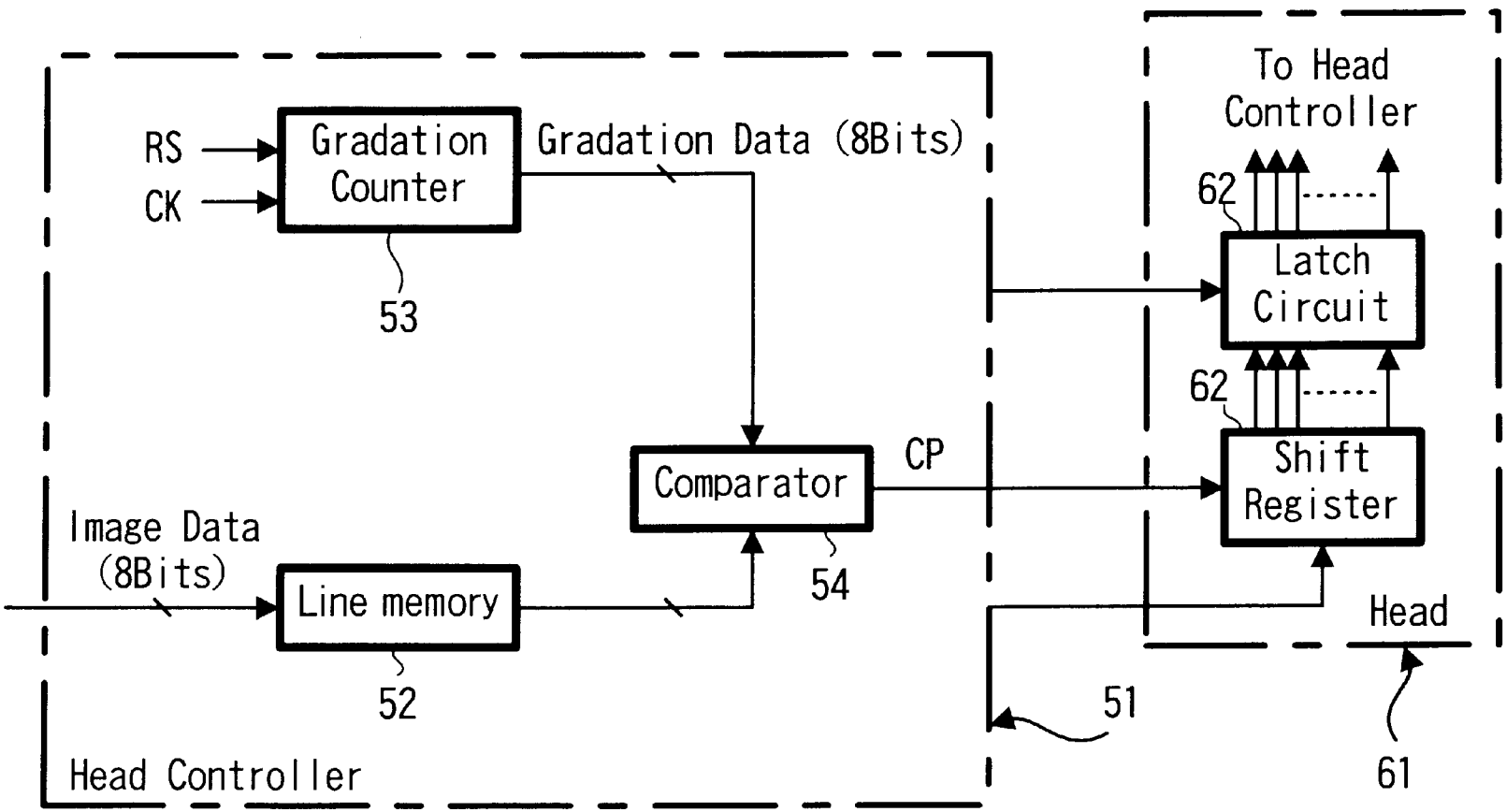
FIG. 1 is a block diagram showing one example of the constitution of a line head controller in a conventional thermal printer.

It is noted that the microcomputer 17 of the head controller 7 feeds a signal indicating with respect to how many image data among the 2056 image data for one line, H signals CP are outputted from the comparator 16, to the number correction section 8 shown in FIG. 1 every time the comparator 16 completes comparison with regard to all the image data for one line read from the line memory 13 (i.e., every time the gradation data at the gradation counter 14 has one value).

The number correction section 8 corrects the length of time for allowing the latch circuit 22 of the head 9 to latch the signals (i.e., the length of time for applying current to the transistors 65 shown in FIG. 2) within a range of a cycle in which the gradation counter 14 counts up gradation data, according to the number of image data indicated by the signals, and thereby controls the occurrence of uneven printing derived from voltage drop at the common resistance (the semiconductor 66 or copper wire 67 in FIG. 2) of the head 9.

While this voltage drop correction section 8 is constituted as a hardware circuit separate from the head controller 7, the section 8 functionally forms a part of the line head controller.

Next, the magnitude of the total current flowing through the respective transistors 65 of the head 9 in this thermal printer will be described.

In the head controller 7, each image data and the zero data are alternately selected and compared with gradation data with regard to each of the 2056 image data for one line read from the line memory 13. Every time the value of the gradation data increases from 0 to 1. . . to 255 with regard to each of the image data, the controller 7 switches selection as to which data is to be selected, the image data or the zero data.

As also shown in FIG. 5, therefore, in any period in which the gradation data has a given value, the zero data is selected with regard to half (the 1028 image data) of the 2056 image data corresponding to the respective transistors 65 and is compared with the gradation data. For that reason, signals CP each indicating that the value of the image data is higher than the value of the gradation data, are not fed to the head 9.

Accordingly, in this thermal printer, throughout the periods in which the gradation data have all values of 0 to 255 (i.e., the entire printing time for one line), the number of transistors 65, to which current is applied, becomes about half the number of the transistors for a thermal printer provided with a conventional head controller such as the head controller 51 shown in FIG. 1 (i.e., the total current applied to the respective transistors 65 is reduced to about half the current in the conventional case).

Therefore, even in a period in which the value of the gradation data is close to the minimum value 0, current is not simultaneously applied to almost all the transistors 65 but applied only to approximately 1028 transistors 65 which are almost half the entire transistors 65. Thus, the maximum value of total current applied to the respective transistors 65 of the head 9 is reduced to about half the value in the conventional case.

As a result, the current flowing through the common resistance (the semiconductor 66 or copper wire 67) of the head 9 becomes considerably lower than the current in the conventional case, while using the same head 9 as the conventional head without newly developing a head having high-resistance head elements.

Consequently, a voltage drop at the common resistance becomes smaller than that in the conventional case, so that it is possible to sufficiently suppress the occurrence of uneven printing by the processing of the number correction section 8.

Further, since the current flowing through the common resistance is smaller than the current in the conventional case, it is possible to make the power supply small in size and to reduce cost compared with the conventional case.

Besides, since the voltage drop at the common resistance becomes smaller than that in the conventional case, efficiency for converting the electric energy of the power supply into the thermal energy of the transistors 65 improves compared with the efficiency in the conventional case.

Each of the image data is compared with every other value of the gradation data (either value of 0, 2, 4, . . . or 254 or value 1, 3, 5, . . . or 255) and two image data corresponding to adjacent two transistors 65 are compared with values of the gradation data different from each other (i.e., while one data is compared with the value 0, 2, 4, . . . or 254 of the gradation data, the other is compared with the value 1, 3, 5, . . . or 255 of the gradation data).

Figure 7:
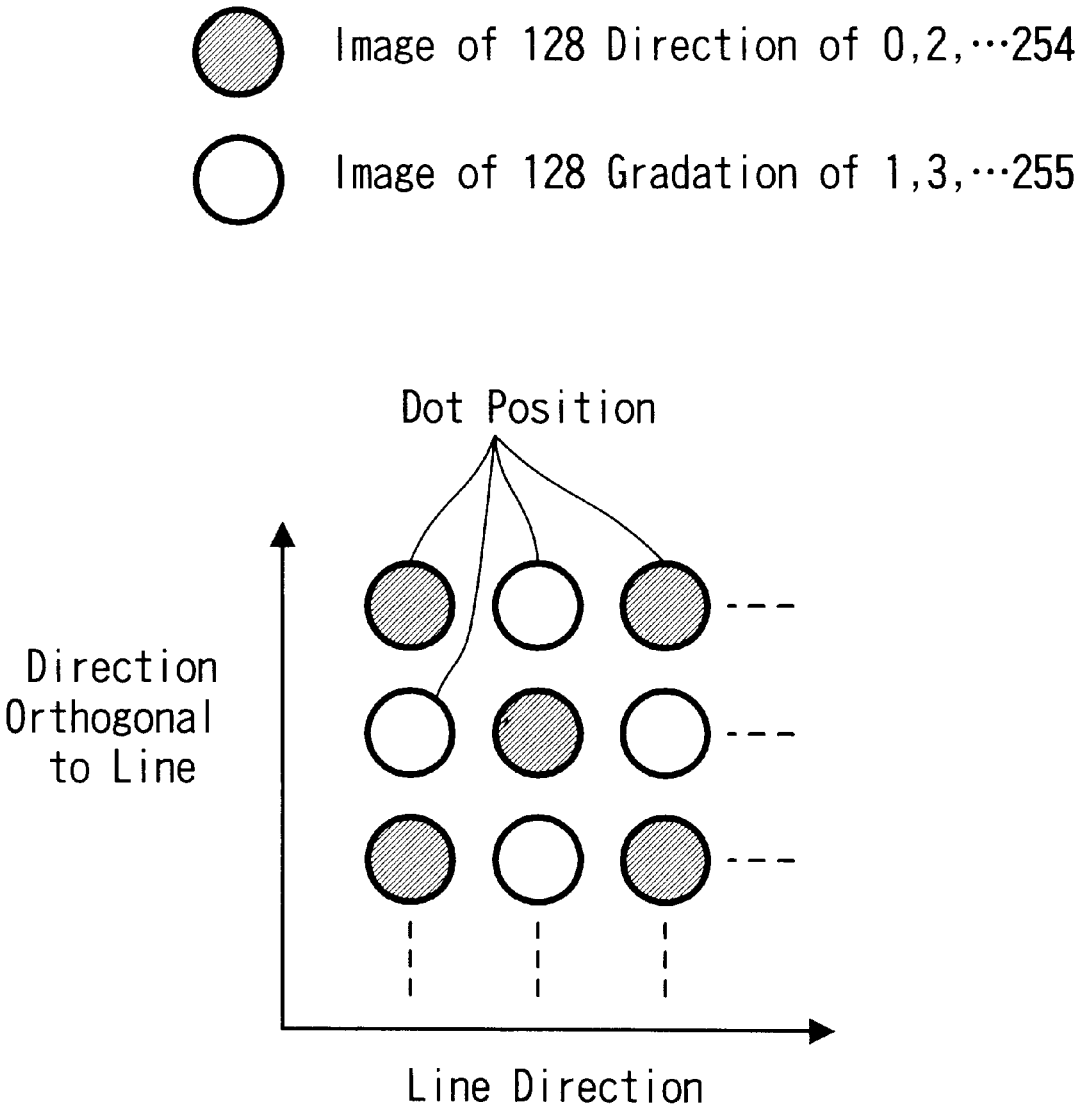
FIG. 7 is a diagram showing the gradations of an image composed by images at the positions of two adjacent dots in an orthogonal direction to a line direction.

As shown in FIG. 7, therefore, an image composed by the images printed by adjacent two transistors 65 (i.e., images at positions of adjacent two dots in a line direction) is printed with the same 256 gradations as those in case of comparing the image data with all the values 0, 1, 2, 3, . . . and 255 of the gradation data.

Furthermore, selection as to which data is to be selected, the image data or the data having value 0 with the gradation data being the same value (e.g., as to which data is to be selected, the image data and the data having value 0 when the value of the gradation value is 1), is switched per line while the gradation data has one value, for the respective 2056 image data for one line read from the line memory 13. Due to this, as shown in FIGS. 5 and 6, selection as to with which data, the image data corresponding to the same transistor 65 is to be compared, the value of 0, 2, 4, . . . or 254 or the value 1, 3, 5, . . . or 255 is switched per line while the gradation data has one value, for the image data corresponding to the same transistor 65.

As shown in FIG. 7, therefore, even an image composed by the images (i.e., images located at positions of two adjacent dots in a direction orthogonal to a line) printed by the same transistor 65 on adjacent two lines is printed with 256 gradations, as well.

Consequently, if an image printed by this thermal printer is viewed, gradations do not appear coarser.

As already stated above, the total current flowing through the respective transistors 65 of the head 9 is reduced to about half the current in the conventional case for the entire printing time for one line. This is equivalent to the fact that the total resistance value of all the transistors 65 of the head 9 is doubled. As can be seen, according to the thermal printer provided with this head controller 7 can equivalently double the total resistance value of the all transistors 65 while using the head 9 of the same structure as that of the conventional head.

In the meantime, the printing power P of the head 9 is expressed as shown in mathematical formula 1 while assuming that voltage applied to the respective transistors 65 through a power supply terminal 68 is V, the total resistance value of all the transistors 65 is R and printing time required for one line is T.

[Mathematical Formula 1]

In this thermal printer, the total resistance value of all the transistors 65 is equivalently doubled. Due to this, as can be judged from the above mathematical formula 1, the printing power of the head 9 is reduced to half the printing power of a thermal printer provided with the conventional head controller such as the head controller 51 shown in FIG. 1. To prevent the printing power from lowering and to maintain the same printing power as the conventional power, voltage V applied to the respective transistors 65 may be set at a voltage multiplied by the square root of 2 of the voltage of the thermal printer provided with the head controller shown in FIG. I (i.e., set at a voltage multiplied by the square root of 2 of the voltage in case of feeding signals indicating the comparison results of comparing the image data with the gradation data for the respective image data to the head) as shown in the following mathematical formula 2.

[Mathematical Formula 2]

Accordingly, it is possible to reduce the current flowing through the common resistance of the head 9 compared with the conventional case while maintaining the same printing power as the conventional power.

It goes without saying that a control signal applied to the control input terminal of the selector 16 in the above-stated example should not be limited to those described above in the items (a) to (d) but may be the following (e) to (h) instead.

(e) When an image is printed on an odd-numbered line, the value of gradation data is even and the odd-numbered image data is read from line memory 13, the zero data inputted to the input terminal i2 is selected. When the even-numbered image data is read from the line memory 13, on the other hand, the image data thus inputted to the input terminal i1 is selected.

(f) When an image is printed on an odd-numbered line, the value of the gradation data is odd and the odd-numbered image data is read from the line memory 13, the image data inputted to the input terminal i1 is selected. When the even-numbered image data is read from the line memory 13, on the other hand, the zero data inputted to the input terminal i2 is selected.

(g) When an image is printed on an even-numbered line, the value of the gradation data is even and the odd-numbered image data is read from the line memory 13, the image data inputted to the input terminal i1 is selected. When the even-numbered image data is read from the line memory 13, on the other hand, the zero data inputted to the input terminal i2 is selected.

(h) When an image is printed on an even-numbered line, the value of the gradation data is odd and the odd-numbered image data is read from the line memory 13, the zero data inputted to the input terminal i2 is selected. When the even-numbered image data is read from the line memory 13, on the other hand, the image data inputted to the input terminal i1 is selected.

Furthermore, in the above example, the gradation counter 14, the selector 15 and the comparator 16 are provided as exclusive hardware circuits at the head controller 7. It is also possible to make the microcomputer 17, for example, have the functions of part or all of these circuits.

Moreover, in the above example, the present invention is applied to the thermal printer for processing image data which represents each gradation with 8 bits (i.e., with 256 density levels) and printing an image. Needless to say, the present invention is also applicable to a thermal printer for processing image data which represents each gradations with bits other than 8 bits (e.g., 10 bits (i.e., with 1024 density levels)) and printing an image. In the latter case, the maximum value of the gradation data at the gradation counter 14 may be set according to the number of bits.

Further, in the above example, 2056 image data for one line are individually compared with gradation data by a single comparator 16. It is also possible to provide a plurality of comparators which share the comparison operation for comparing the 2056 image data for one line with gradation data among them in the head controller 7 and to provide shift registers corresponding to the respective comparators in the head 9.

Furthermore, in the above example, the present invention is applied to the thermal printer having 2056 head elements (i.e., the number of dots per line is 2056). Needless to say, the present invention is also applicable to a thermal printer the number of which head elements is not 2056.

Additionally, in the above example, the present invention is applied to the thermal printer. It is also possible to apply the present invention to a printer other than the thermal printer.

In addition, the present invention should not be limited to the above example and may have other various constitutions without departing from the gist of the present invention.

As stated so far, according to the present invention, it is possible to considerably reduce current flowing through the common resistance of the line head compared with the conventional case while using the same head as the conventional head without newly developing a head having high-resistance head elements in a thermal printer for printing an image by the line head.

Thus, voltage drop at the common resistance of the line head becomes smaller than voltage drop in the conventional case, so that it is possible to obtain an effect that the occurrence of uneven printing can be sufficiently suppressed by voltage drop correction.

Furthermore, since current flowing through the common resistance becomes lower, it is possible to obtain effects that a power supply for supplying current to the head can be made smaller in size and manufactured at lower cost.

Moreover, since the voltage drop at the common resistance is smaller than voltage drop in the conventional case, it is possible to obtain an effect that efficiency for converting the electric energy of the power supply into the thermal energy of the head elements improves compared with the conventional case.

Also, an effect that the gradations can be prevented from appearing coarser if viewing a printed image, is obtained.

If selection as to which data is to be selected, data on the image and data having value 0 with the gradation data being the same value is switched per line for each of the image data, an effect that the gradations can be further prevented from appearing coarser if viewing a printed image, is obtained.

Further, if a signal correcting current-carrying time for carrying current to head elements of the line head is fed to the line head in accordance with the signal indicating the comparison result, an effect of capable of further suppressing the generation of uneven printing resulting from voltage drop at the common resistance of the line head.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A line head controller of a printer printing an image by a line head, wherein the line head controller controls:

generating gradation data representing image gradations by stages;

alternately selecting each image data the number of which corresponds to the number of head elements of said line head, and data of value 0, and switching selection as to which data is to be selected, the image data or the data of value 0, every time a value of said gradation data changes; and feeding a signal indicating a comparison result of comparing said selected data with said gradation data to said line head.

2. The line head controller of a printer according to claim 1, wherein said line head controller further switches the selection as to which data is to be selected, the image data or said data of value 0 with said gradation data being a same value per line for the respective image data.

3. The line head controller of a printer according to claim 2, wherein said line head controller further controls feeding a signal correcting current-carrying time for carrying current to head elements of said line head to said line head in accordance with the signal indicating the comparison result.

4. A printer printing an image by a line head, comprising a line head controller, wherein the line head controller controls:

generating gradation data representing image gradations by stages;

alternately selecting each image data the number of which corresponds to the number of head elements of said line head, and data of value 0, and switching selection as to which data is to be selected, the image data or the data of value 0, every time a value of said gradation data changes; and feeding a signal indicating a comparison result of comparing said selected data with said gradation data to said line head.

5. The printer according to claim 4, wherein line head controller further switches the selection as to which data is to be selected, the image data or said data of value 0 with said gradation data being a same value per line for the respective image data.

6. The printer according to claim 5, wherein said line head controller further controls feeding a signal correcting current-carrying time for carrying current to the head element of said line head to said line head in accordance with the signal indicating the comparison result.

7. The line head controller of a thermal printer printing an image by a line head, comprising:

gradation generation means for generating gradation data representing image gradations by stages;

selection means for alternately selecting each image data the number of which corresponds to the number of head elements of said line head, and data of value 0, and for switching selection as to which data is to be selected, the image data or the data of value 0, every time a value of said gradation data changes; and comparison means for feeding a signal indicating a comparison result of comparing said selected data with said gradation data to said line head.

8. The line head controller of a thermal printer according to claim 7, wherein said selection means further switches the selection as to which data is to be selected, the image data or said data of value 0 with said gradation data being a same value per line for the respective image data.

9. The line head controller of a thermal printer according to claim 8, further comprising:

voltage drop correction means for feeding a signal correcting current-carrying time for carrying current to head elements of said line head to said line head in accordance with the signal indicating the comparison result.

10. A thermal printer printing an image by a line head, comprising a line head controller, said line head controller comprising:

gradation generation means for generating gradation data representing image gradations by stages;

selection means for alternately selecting each image data the number of which corresponds to the number of head elements of said line head, and data of value 0, and for switching selection as to which data is to be selected, the image data or the data of value 0, every time a value of said gradation data changes; and comparison means for feeding a signal indicating a comparison result of comparing said selected data with said gradation data to said line head.

11. The thermal printer according to claim 10, wherein said selection means further switches the selection as to which data is to be selected, the image data or said data of value 0 with said gradation data being a same value per line for the respective image data.

12. The thermal printer according to claim 11, further comprising:

voltage drop correction means for feeding a signal correcting current-carrying time for carrying current to head elements of said line head to said line head in accordance with the signal indicating the comparison result from the comparison means.

13. A printer printing method of printing an image by a line head, comprising:

a gradation generation step of generating gradation data representing image gradations by stages;

a selection step of alternately selecting each image data the number of which corresponds to the number of head elements of said line head, and data of value 0, and of switching selection as to which data is to be selected, the image data or the data of value 0, every time a value of said gradation data changes; and a comparison step of feeding a signal indicating a comparison result of comparing said selected data with said gradation data to said line head.

14. The printer printing method according to claim 13, wherein in said selection step, the selection as to which data is to be selected, the image data or said data of value 0 with said gradation data being a same value is switched per line for the respective image data.

15. The printer printing method according to claim 14, further comprising:

a voltage drop correction step of feeding a signal correcting current-carrying time for carrying current to head elements of said line head to said line head in accordance with the signal indicating the comparison result.

16. The printer printing method according to claim 13, wherein said printer is a thermal printer.

17. The printer printing method according to claim 14, wherein said printer is a thermal printer.

18. The printer printing method according to claim 15, wherein said printer is a thermal printer.

* * * * *